US010017352B2

(12) United States Patent
Braack

(10) Patent No.: US 10,017,352 B2
(45) Date of Patent: Jul. 10, 2018

(54) LARGE DIAMETER LAY-FLAT HOSE SPOOL APPARATUS AND METHOD

(71) Applicant: Robert Braack, Coleman, TX (US)

(72) Inventor: Robert Braack, Coleman, TX (US)

( * ) Notice: Subject to any disclaimer, the term of this patent is extended or adjusted under 35 U.S.C. 154(b) by 171 days.

(21) Appl. No.: 14/984,678

(22) Filed: Dec. 30, 2015

(65) Prior Publication Data

US 2016/0194178 A1 Jul. 7, 2016

Related U.S. Application Data

(60) Provisional application No. 62/137,435, filed on Mar. 24, 2015, provisional application No. 62/099,718, filed on Jan. 5, 2015.

(51) Int. Cl.

| | |
|---|---|
| ***B65H 49/32*** | (2006.01) |
| ***B65H 75/42*** | (2006.01) |
| ***B65H 49/34*** | (2006.01) |
| ***B65H 75/44*** | (2006.01) |

(52) U.S. Cl.

CPC ..... *B65H 75/425* (2013.01); *B65H 49/32* (2013.01); *B65H 49/34* (2013.01); *B65H 75/4481* (2013.01); *B65H 2701/332* (2013.01)

(58) Field of Classification Search

CPC .. B65H 75/425; B65H 75/4481; B65H 49/32; B65H 49/34

See application file for complete search history.

(56) References Cited

U.S. PATENT DOCUMENTS

| | | | | |
|---|---|---|---|---|
| 4,454,999 | A | 6/1984 | Woodruff | |
| 4,664,331 | A | 5/1987 | Halbrook | |
| 5,156,355 | A * | 10/1992 | Wadle | B65H 54/2896 242/366 |
| 6,419,424 | B1 * | 7/2002 | Null | B65H 49/24 242/557 |
| 6,435,447 | B1 * | 8/2002 | Coats | B65H 54/2848 242/157.1 |
| 7,530,521 | B2 * | 5/2009 | Puck | A01C 23/008 242/403 |
| 8,256,692 | B2 | 9/2012 | Knowles | |
| 8,814,075 | B1 | 8/2014 | Turner et al. | |

* cited by examiner

*Primary Examiner* — Sang K Kim

(74) *Attorney, Agent, or Firm* — Geoffrey A. Mantooth; Brian K. Yost

(57) ABSTRACT

A large diameter lay-flat hose spool apparatus has a mobile platform with a chassis and wheels. Side supports extend up from the chassis. An axle bears on the side supports, spanning a gap therebetween. Plural spools are rotatably mounted on the axle. Each spool has at least one rim and a length of lay-flat hose wound thereon. A driver rotates the individual spools about the axle independently of the other spools. The driver has a first actuator that moves a drive wheel into and out of contact with a rim of one of the spools. The driver has a second actuator that moves the drive wheel from one of the spool rims to another of the spool rims. A motor rotates the drive wheel. A controller system operated the motor, the first actuator and the second actuator.

11 Claims, 6 Drawing Sheets

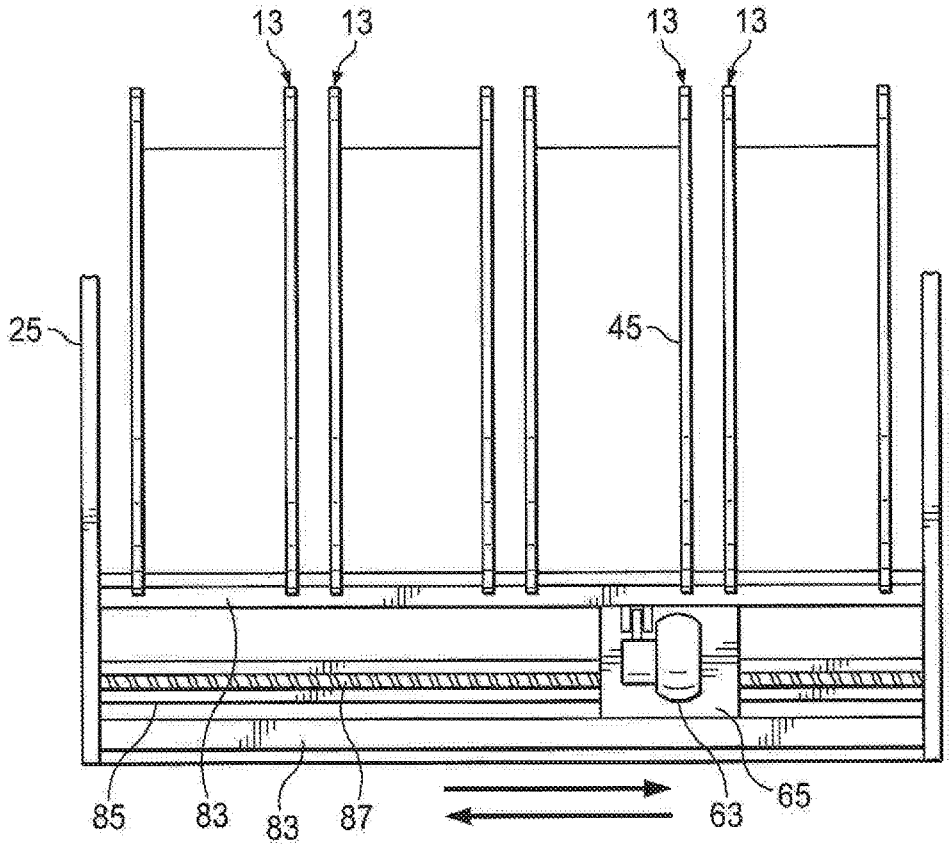
FIG. 3
FIG. 4
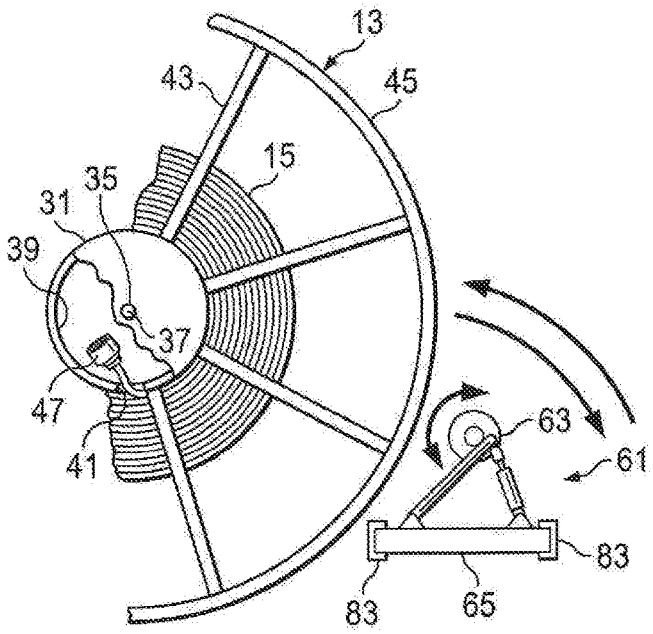

LARGE DIAMETER LAY-FLAT HOSE SPOOL APPARATUS AND METHOD

FIELD OF THE INVENTION

The present invention relates to apparatuses and methods for spooling and unspooling large diameter lay-flat hoses.

BACKGROUND OF THE INVENTION

There are applications where use of temporary pipe is required. For example, in oil and gas well drilling, large quantities of water are required to drill and complete a well. To provide the water, temporary pipe is laid from a water source such as a pond or water well to the oil and gas well. The pipe is usually laid on top of the ground, instead of being buried. Because of the large quantities of water needed, the pipe is of a relatively large diameter.

As an alternative to pipe, hose may be used. Hose has an advantage over pipe in that the lengths of hose are much longer than the individual segments of pipe, requiring fewer couplings. The hose can collapse to a lay-flat configuration when not in use. This lay-flat ability allows a longer length of the hose to be stored on a single spool.

The hose is unwound from the spool to deploy onto the ground. However, once all of the hose has been unwound, a new spool with additional hose must be obtained. The deployment and changing out of spools can be laborious and time consuming.

SUMMARY OF THE INVENTION

A large diameter lay-flat hose spool apparatus comprises a mobile platform, which platform comprises a chassis and wheels. Side supports bear on the chassis. The side supports extend up from the chassis and are separated from one another by a gap. An axle is supported by the side supports and spans the gap. Plural spools are rotatably mounted on the axle. Each of the spools has at least one rim. Each of the spools contains a length of the lay-flat hose. Each length of the lay-flat hose has two ends and a coupling on each end. A driver comprises a drive wheel, a first actuator and a second actuator, the first actuator moving the drive wheel into contact with and out of contact with a respective one of the spool rims, the second actuator moving the drive wheel from one of the spool rims to another of the spool rims. A motor rotates the drive wheel, wherein when the drive wheel contacts one of the spool rims and is rotated by the motor, the respective spool rotates independently of the other spools on the axle. A controller system is connected to the first actuator, the second actuator and the motor.

In accordance with one aspect, the mobile platform comprises a trailer.

In accordance with another aspect, each of the spools comprises a bushing that receives the axle.

In accordance with another aspect, the at least one rim on each of the spools comprises an elastomeric surface that contacts the drive wheel when the respective spool is being driven by the drive wheel.

In accordance with another aspect, the drive wheel, the motor and the first actuator are coupled to a sled, the sled moving on at least one rail, the rail extending between the side supports.

In accordance with another aspect, the controller system comprises a first controller connected to the first actuator, a second controller connected to the second actuator and a third controller connected to the motor, the third controller capable of operating the motor in an unspool direction and a spool direction.

In accordance with another aspect, the spools on the mobile platform have a forward end and a rearward end, the motor, the first actuator and the second actuator located on the forward end of the spools, the third controller located adjacent to the rearward end of the spools.

In accordance with another aspect, the spools on the mobile platform have a forward end and a rearward end. The apparatus further comprises a keeper member located adjacent to the rearward end of the spools, the keeper member having a notch therein for each spool, each notch receiving a coupling from the respective spool. For each of the notches, a keeper located on the keeper member, the respective keepers movable between a closed position and an open position, wherein when the respective keeper is in the closed position the respective notch is closed and the respective coupling in the notch is prevented from exiting the notch, and when the respective keeper is in the open position the respective notch is open and the respective coupling in the notch can exit and enter the notch.

In accordance with another aspect, a flexible puller is on at least one of the spools, the puller capable of being wrapped about the respective spool and capable of extending from the spool, the puller having a free end with a grapple thereon, the grapple capable of attaching to one of the hose couplings.

In accordance with another aspect, the mobile platform comprises a trailer. The at least one rim on each of the spools comprises an elastomeric surface that contacts the drive wheel when the respective spool is being driven by the drive wheel. The drive wheel, the motor and the first actuator are coupled to a sled, the sled moving on at least one rail, the rail extending between the side supports. The controller system comprises a first controller connected to the first actuator, a second controller connected to the second actuator and a third controller connected to the motor, the third controller capable of operating the motor in an unspool direction and a spool direction. The spools on the mobile platform have a forward end and a rearward end, the motor, the first actuator and the second actuator located on the forward end of the spools, the third controller located adjacent to the rearward end of the spools.

A large diameter lay-flat hose spool apparatus, comprises a mobile platform, which platform comprises a chassis and wheels. Supports bear on the chassis, the supports extending up from the chassis. An axle is supported by the supports. A spool is rotatably mounted on the axle, the spool having at least one rim, the spool containing a length of the lay-flat hose, each length of the lay-flat hose having two ends and a coupling on each end, the spools on the mobile platform have a forward end and a rearward end. A driver is mounted on the mobile platform, the driver rotates the spool so as to unroll the lay-flat hose from the spool and roll the lay-flat hose onto the spool. A keeper member is located adjacent to the rearward end of the spool, the keeper member having a notch therein, the notch receiving a coupling from the spool. A keeper is located on the keeper member, the keeper movable between a closed position and an open position, wherein when the keeper is in the closed position the notch is closed and the coupling in the notch is prevented from exiting the notch, and when the keeper is in the open position the notch is open and the coupling in the notch can exit and enter the notch. A flexible puller on the spool, the puller capable of being wrapped about the spool and capable of extending from the spool, the puller having a free end with a grapple thereon, the grapple capable of attaching to one of the hose couplings.

A method of manipulating large diameter lay-flat hose, comprises the steps of providing a mobile platform with plural spools rotatably mounted on an axle. Moving the mobile platform across ground. Rotating one of the spools independently of the other spools on the axle to manipulate a length of lay-flat hose on the one spool, the hose being manipulated by either unspooling the hose from the one spool onto the ground adjacent to the mobile platform or by spooling the hose from the ground onto the one spool. Removing the spools and the axle as a unit from the mobile platform. Exchanging at least one of the spools on the axle for another spool. Replacing the unit of the spools and the axle onto the mobile platform.

In accordance with another aspect, wherein the step of removing the spools and the axle as a unit from the mobile platform further comprises the step of placing the spools on the ground.

In accordance with another aspect, providing a mobile platform with at least one spool rotatably mounted to the platform, the spool having a length of lay-flat hose wound thereon, the lay-flat hose having two ends with a coupling on each end. Moving the mobile platform across ground. Rotating the spool so as to unspool the lay-flat hose wound on the spool onto the ground adjacent to the mobile platform, so that one of the couplings is on the ground and the other coupling is on the spool. Connecting a flexible puller to the other coupling and allowing the rotation of the spool to separate the other coupling from the spool, and unwind the puller from the spool, the other coupling being supported by the puller until the other coupling contacts the ground. Removing the puller from the other coupling.

In accordance with another aspect, further comprising the step of providing a notch in the mobile platform and storing the one coupling therein while the mobile platform is moving and the spool is stationary with respect to the platform.

In accordance with another aspect, further comprising the step of providing a keeper adjacent to the notch, and moving the keeper to an open position to allow the one coupling to be removed from or inserted into the notch, and moving the keeper to a closed position to retain the one coupling inside the notch.

In accordance with another aspect, further comprising the step of connecting the flexible puller to the keeper when the other coupling has been laid on the ground.

BRIEF DESCRIPTION OF THE DRAWINGS

FIG. 3 is a plan view of the spool driver and the spools.

FIG. 4 is a side view of the spool driver and a spool.

DESCRIPTION OF THE PREFERRED EMBODIMENT

Figure 1:
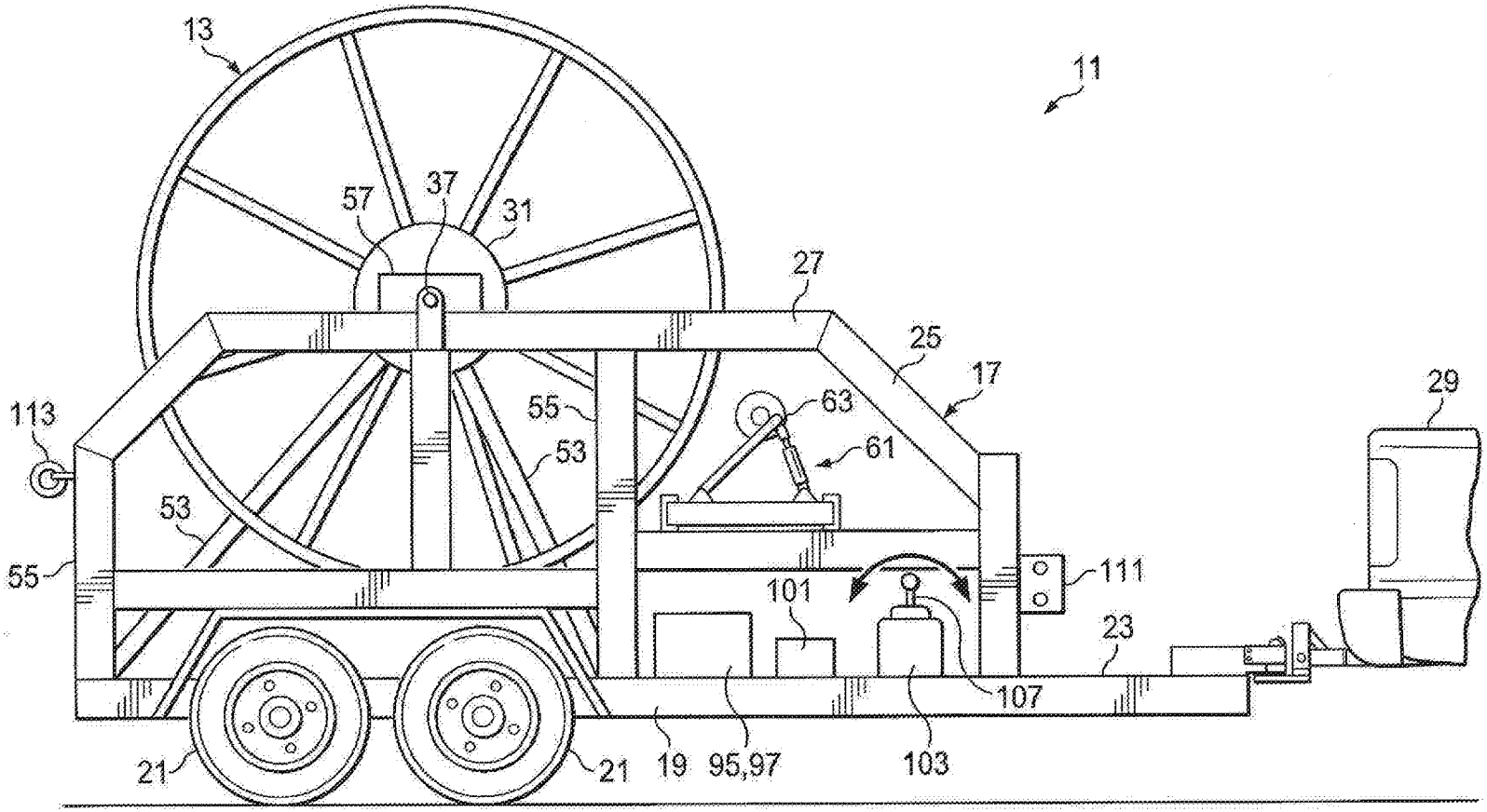
FIG. 1 is a side view of the apparatus of the present invention, shown in conjunction with a towing vehicle.

The apparatus 11 provides a mobile platform for mounting plural spools 13. Each spool is capable of containing large diameter lay-flat hose 15. Hoses unspool (deploy) from and spool (retrieve) onto individual spools, with each spool 13 operating independently of the other spools. The apparatus allows a large quantity of hose to be transported from place to place and to be deployed as well as retrieved. For example, a typical spool will carry 660 feet of hose. An apparatus with four spools thus carries one-half (½) mile of hose.

By storing large quantities of hose, deployment of the hose is more efficient since longer lengths of hose can be deployed from a single platform. In addition, unspooling and respooling the ends of hose is made easier on personnel.

In the description herein, terms such as "front", "rear" and "side" are used in conjunction with the orientation of a towed platform. The front of the platform is closest to the towing vehicle, while the rear is the farthest.

In the preferred embodiment, the mobile platform is a trailer 17 (see FIGS. 1 and 2) having a chassis 19, wheels 21 and a tongue 23. The chassis 19 has a generally rectangular frame work or bed supported by the wheels 21. The trailer 17 also has side supports 25 extending vertically up from the chassis. The side supports 25 each have a horizontal bar 27 for supporting the spools at a distance above the chassis bed. In the preferred embodiment, the trailer has dual single wheel axles, with the axles mounted to the chassis by springs. The wheels 21 are conventional tires. The tongue 23 is coupled to the chassis and is capable of connecting to a towing vehicle 29, such as a truck.

The trailer 17 has a number of spools 13 rotatably mounted thereto. Each spool 13 has a hub 31 and flanges 33 extending out from the hub. The hub 31 is a hollow cylinder. The hub has a central cylinder sleeve 35 thereon (see FIG. 4) for receiving the spool axle 37. The hub has a larger diameter than the axle cylinder 35. Standoff plates support the hub on the cylinder 35. A cavity 39 is located inside of the hub. The hub has an opening 41 therein communicating with the cavity. A coupling 47 can be located in the hub cavity 39. The flanges 33 are, in the preferred embodiment, spokes 43 that radiate from the hub and intersect a circular rim 45.

The spools carry large diameter lay-flat hose 15, which hose is conventional and commercially available. Such hose typically comes in 8, 10 or 12 inch diameters. A single length of hose is wound onto the spool, around the hub. Each end of the hose has a coupling 47.

The spools 13 are mounted to the spool axle 37, which axle is in turn mounted to the horizontal bars 27 of the side supports 25, such that the spools are located between the side supports. The spools are positioned side-by-side, or flange to flange, along the axle. The hub central sleeve 35 receives the axle and serves as bushing and allows the spools to rotate about the axle. Axle spacers or sleeves may be used between the spools to maintain a minimum space between the spools. The spools do not contact one another and rotate independently of each other on the axle.

The axle 37 is supported not only on its ends, but also in the middle by a central support 51, which bears on the trailer chassis by way of fore and aft legs 53. The side supports 35 have vertical supports 55. The vertical supports 55 in the fore and aft legs 53 straddle the wheel axles so that a portion of the spool weight is located in front of the axles and the remainder of the spool weight is located aft of the wheel axles (see FIG. 1). Thus, the weight of the spools is distributed across the wheel axles. The spool axle 37 is mounted to the side supports by end caps 57 or plates. The end caps 57 are easily removed from the side supports so that the axle can be removed. If the spool becomes damaged, it can be quickly and easily replaced. For example, a forklift can be used to lift the spool assembly and axle out of the trailer. The damaged spool is removed from the axle and replaced with a fresh spool. The forklift is then used to lift the spool assembly back into the trailer.

Figure 7:
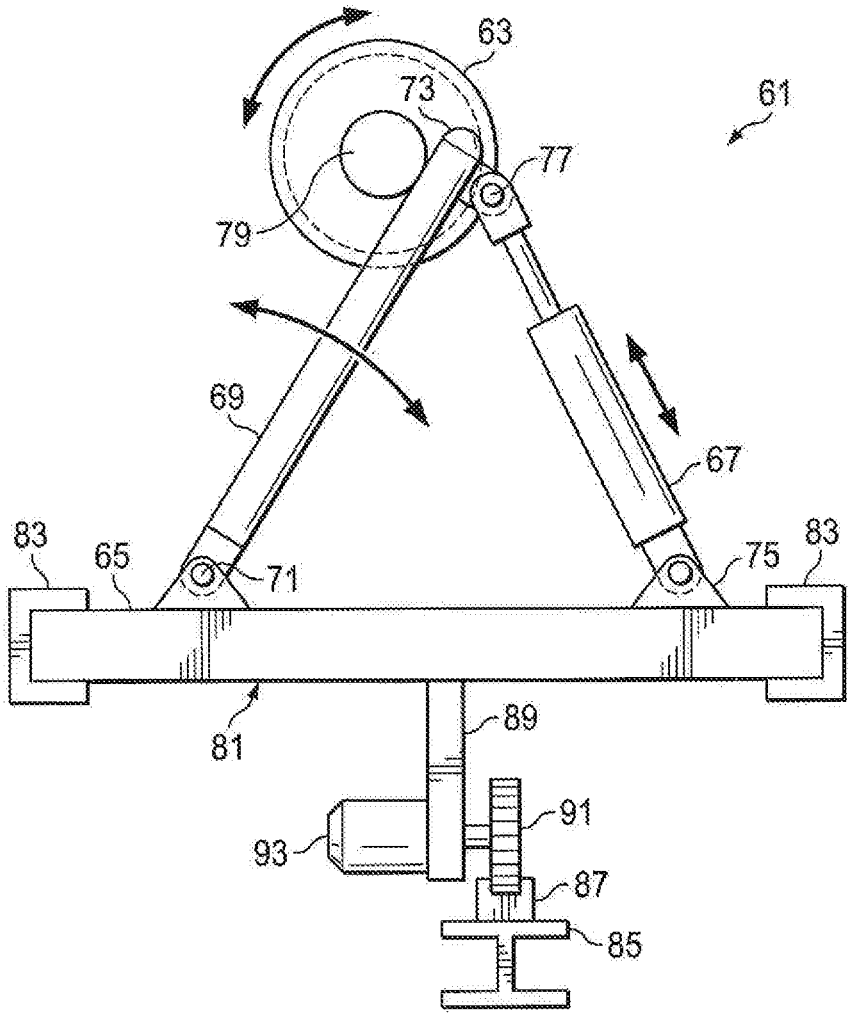
FIG. 7 is a detailed side view of the spool driver.

The apparatus 11 has a spool driver 61 for rotating the individual spools 13 (see FIGS. 4 and 7). The spool driver is located in front of the spools between the spools and trailer tongue. This allows the hose to be unspooled from the rear of the trailer. The spool driver 61 rotates a single spool 13, with the remaining spools not rotating. The spool driver has a foam filled wheel 63 mounted to a sled 65 by way of an actuator 67. The wheel is conventional, with a tire mounted to a hub. The tire has tread. The foam filling provides more traction of the tire against the outside diameter of the spool flange 33.

The wheel 63 is mounted to a pivot arm 69. One end 71 of the pivot arm 69 is pivotally mounted to the sled 65. The wheel 63 is rotatably mounted to the other end 73. An actuator 67 in the form of a hydraulic cylinder moves the pivot arm 69. One end 75 of the hydraulic cylinder is pivotally mounted to the sled, and the other end 77 is pivotally coupled to the pivot arm 69. Thus, the wheel 63 is moved in and out of contact with the selected spool. As the cylinder 67 extends, the pivot arm 69 is moved toward the selected spool and the wheel 63 contacts the rim 45 of the spool flange. As the cylinder 67 retracts, the pivot arm 69 is moved away from the spool and the wheel is no longer in contact with the spool. The wheel 63 is rotated by a hydraulic motor 79 mounted to the wheel hub and the pivot arm.

The wheel 63 is moved from spool to spool by way of the sled 65 (see FIGS. 3, 4 and 7). The sled 65 includes a platform 81. The pivot arm 69 and hydraulic cylinder 67 are pivotally coupled to the platform 81. The sled 65 is located between a pair of rails 83, which rails extend between the side supports 25. Each rail 83 is a "U" shaped channel, oriented on a side; the two channels face each other and are separated by a gap. The sled spans the gap between the rails 83 and is located inside of each rail channel. The sled 65 moves side-to-side along the rails.

The sled can be moved along the rails in several ways. In the preferred embodiment, a modified rack and pinion is used. Underneath the rails 83, and parallel thereto, is a beam 85 that extends between the side supports 25. A drive or linkage chain 87 is supported by the beam; the chain is stretched along the beam, with the openings between the linkages facing up toward the sled. The ends of the chain 87 are anchored to the side supports 25, with one end capable of being pulled so as to tighten the chain along the beam. The chain 87 is fixed in place along the beam 85 and does not move. Instead, the sled 65 moves relative to the chain. The sled platform 81 has a plate 89 descending therefrom. A sprocket 91 is rotatably mounted to one side of the platform 891 the sprocket engages the chain 85. A hydraulic motor 93 is mounted to the other side of the plate 89. The motor 93 rotates the sprocket 91. As the sprocket 91 rotates, it moves the sled along the chain 87, with the sled following in the rails. The sled is capable of moving in both side directions, so as to align the wheel with the desired spool.

The sled 65 can be moved in other ways. For example, an endless chain can be looped around a drive sprocket and an idle sprocket, with the sled coupling to the chain. The drive sprocket moves the chain and the sled along the rails.

Figure 5:
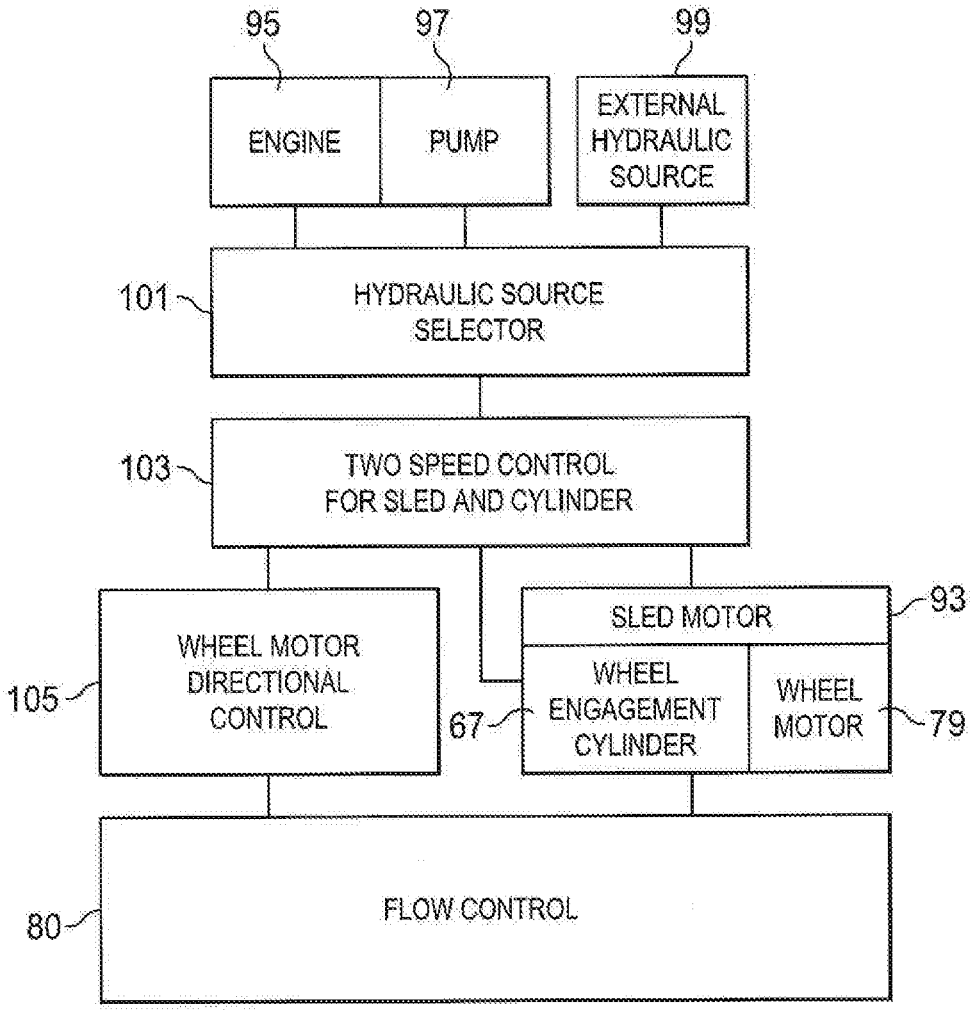
FIG. 5 is a schematic view of the hydraulic circuit and various hydraulic components.

The apparatus uses hydraulics for movement. However, other types of actuators can be used, such as electric motors. FIG. 5 shows the hydraulic system.

An engine 95 is provided to power a hydraulic pump 97. The engine is of the internal combustion type, such as gasoline or diesel. The hydraulic pump provides pressurized hydraulic fluid to the system. As an alternative to the engine and pump, an external source 99 of hydraulic fluid can be used. For example, some towing vehicles have a hydraulic source such as a power takeoff. The ability to use an external hydraulic source provides flexibility should the engine run out of fuel or have mechanical problems.

The pump 97 and hoses for the external hydraulic source 99 are connected to a hydraulic source selector 101. The hydraulic source selector 101 is connected to a sled controller 103. The controller 103 is in turn connected to the sled motor 93, the wheel engagement cylinder 67 and the wheel motor 79. The wheel motor 79 is coupled to a wheel motor directional control 105, which control is also connected to the sled controller 103.

The speed of the wheel 63 can be controlled and varied if desired. In one embodiment, a flow controller 80 is provided in-line with the wheel motor 79. The flow controller allows the flow of hydraulic fluid to the wheel motor to be adjusted, thereby varying the speed of the wheel motor and the wheel 63. The flow controller 80 is typically set at the factory, but may be adjusted in the field. Restricting the flow of fluid through the motor 79 causes the wheel 63 to rotate at a slower speed. Allowing more fluid to flow through the motor 79 causes the wheel to rotate faster.

The sled controller 103 has a joystick 107 (see FIG. 1) with forward and rearward positions, as well as left and right positions. Moving the joystick to the left relative to the trailer causes motor 93 to operate in one direction and the sled to move to the left along the rails 83. Likewise, moving the joystick to the right relative to the trailer causes the motor 93 to operate in the other direction and the sled to move to the right. The operator positions the drive wheel 63 in line with the rim 45 of the selected spool (see FIG. 3). Once the drive wheel is positioned, the operator moves the joystick toward to the spool, or rearward, so as to extend the cylinder 67 and move the drive wheel into contact with the spool rim. The controller 103 is preferably located at the same end of the trailer as the drive wheel to allow the operator to visually monitor the movement and position of the drive wheel. In addition, the joystick is moved in the same direction as the sled and the drive wheel. To retract the drive wheel from the spool, the joystick 107 is pulled away from the spool to the forward position. This causes the cylinder 67 to shorten and retracts the drive wheel from the spool. The hydraulic circuit operating the cylinder 67 has a holding valve (not shown). The holding valve prevents hydraulic fluid from leaking out of the cylinder. As the spool is rotating, the holding valve ensures that the wheel 63 can maintain contact with and rotate the spool.

Figure 6:
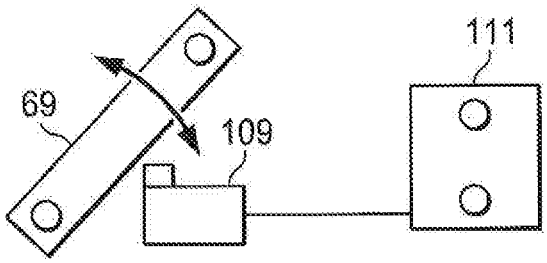
FIG. 6 is a schematic view of the electrical circuit.

The spool driver is equipped with a safety provision to insure that the drive wheel is disengaged from the spool before the sled can be moved laterally. The sled platform (see FIG. 6) is provided with an electric contact switch 109. The switch is located such that the pivot arm 69 contacts the switch 109 when the pivot arm is fully retracted. The switch 109 is connected to an indicator light 111. When the switch is activated by the fully retracted drive wheel, a green light illuminates. If the switch is not activated, then a red light illuminates. The green light indicates to the operator that the sled can now be moved in a sideways direction.

The wheel motor directional controller 105 is located near the rear end of the trailer. The controller 105 has forward, neutral and reverse positions. In the forward position, the motor 79 rotates in one direction as the wheel 63 rotates the spool and winds the hose. In the reverse or rear position, the motor 79 rotates in the other direction wherein the wheel 63 rotates the spool and unwind the hose.

The contact between the wheel 63 and the spool rim 45 can be designed so as to provide traction and reduce slip. In one embodiment, the outside surface of the rim 45 is smooth metal. However, such a surface tends to slip against the wheel 63 when wet. The rim surface can be treated to roughen the surface, such as by etching, sandblasting, etc.

Figure 9:
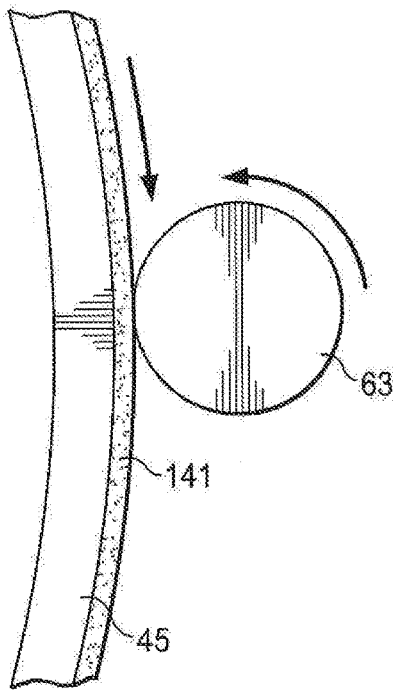
FIG. 9 is a detail side view of a spool rim and the wheel.
Figure 10:
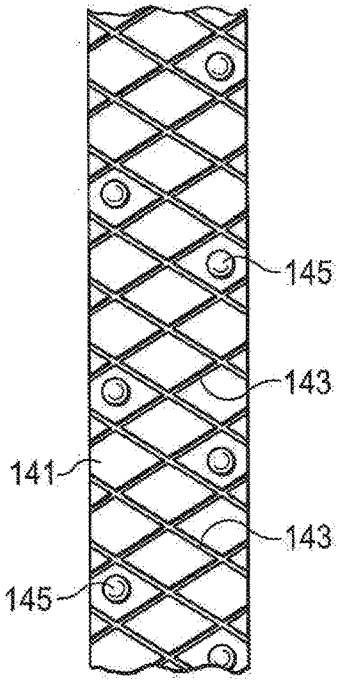
FIG. 10 is an end view of the spool rim.

Alternatively, the rim can be modified by providing another material. In FIGS. 9 and 10, there is shown one such embodiment, wherein an elastomeric strip 141 is located on the rim. The strip 141, which is made of rubber, has a width that is the same as the rim, and extends around the circumference of the rim 45. The rubber strip can be smooth, or as in the preferred embodiment, provided with a tread 143 or roughened surface. FIG. 10 shows one such tread pattern, namely a diamond pattern. The tread 143 faces radially out so as to contact the wheel 63.

The rubber strip is coupled to the spool rim. In the preferred embodiment, the strip is secured with rivets 145. The rivets extend through the tread and the rim. The rivet heads on the tread surface are rounded. An adhesive can also be used.

Each spool 13 has one respective rim 45 lined with the rubber strip 141. Although both rims 45 of a spool can be equipped with a rubber strip, only one rim needs to be so equipped. The rubber strip works well, particularly in wet conditions. The rubber wheel 63 contacts the rubber strip and as a result, little or no slip occurs.

In operation, the trailer 17 is connected to a towing vehicle 29, such as a truck. The hose 15 is to be laid along a selected path, whether the path is on a road, through an open area, through a cleared area, etc. The trailer is positioned at one end of the hose path. With the engine and pump 95, 97 in operation, the operator operates the spool selector controller 103 to move the sled 65 sideways until the drive wheel 63 is aligned with a rim 45 from a selective one of the spools. Once the drive wheel is satisfactorily aligned, the operator operates the controller 103 to engage the wheel 63 into contact with the selected spool 13. The cylinder 67 extends, causing the pivot arm 69 to move forward toward the spool. The wheel 63 contacts the rubber strip 141. Next the operator stands near the rear of the trailer and operates the wheel controller 105 in the unspooled direction. The motor 79 rotates the drive wheel 63, which in turn rotates the spool in the desired direction. The use of a bushing 35 to mount the spool to the axle reduces the amount of torque needed to rotate the spool, whether empty or full. As the spool rotates, the hose unwinds.

Figure 2:
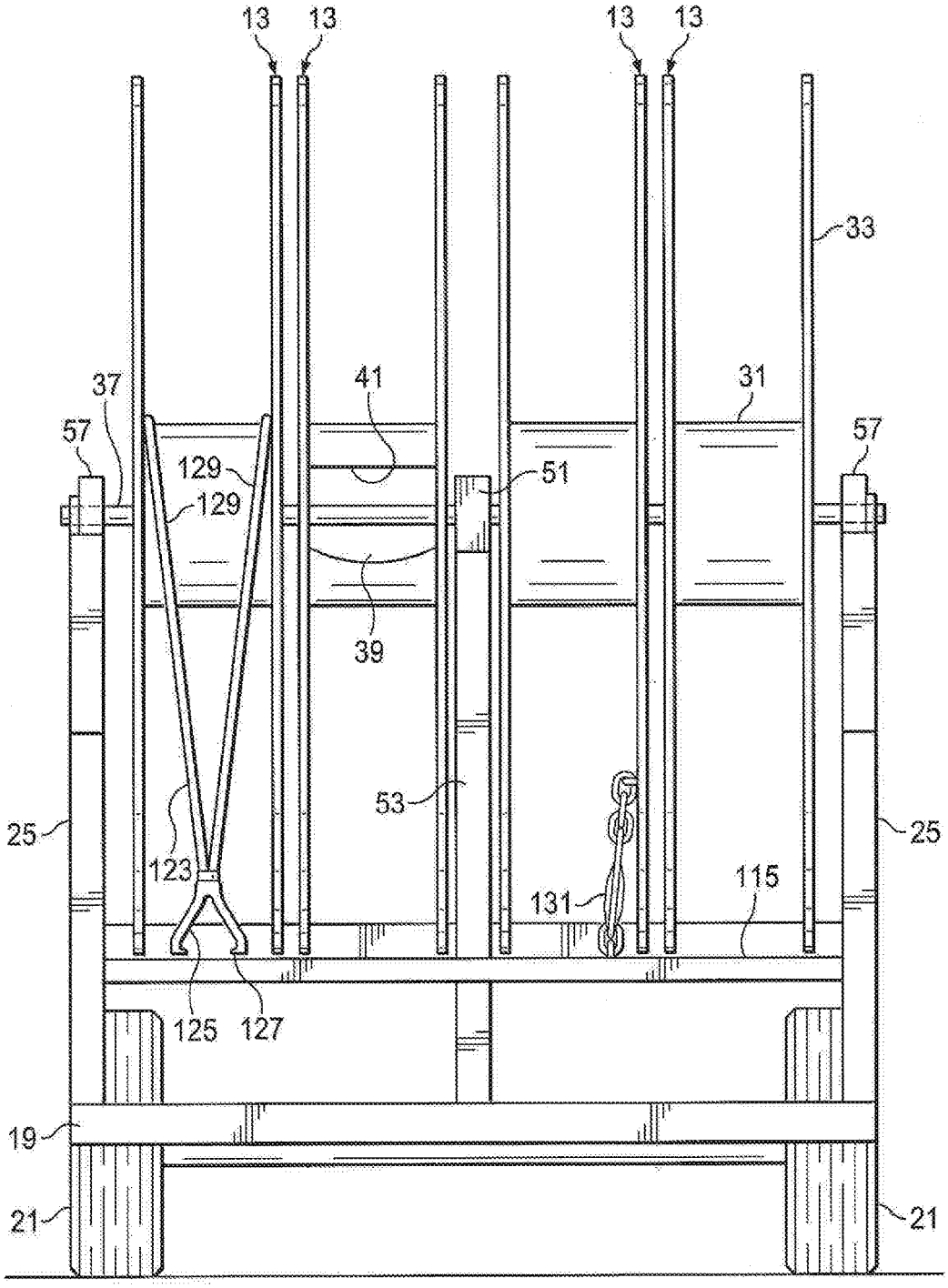
FIG. 2 is a rear end view of the apparatus.

The trailer has a roller 113 across the rear end (see FIG. 1). The roller is positioned so that the unwinding hose contacts the roller and then moves to the ground.

As the spool is rotated, the trailer is towed in a forward direction. The speed of the trailer over the ground is the same as the speed of the hose being unwound from the spool.

The laying of the hose continues until the spool is almost empty. As will be described in more detail below, the spools are equipped with a coupling device that eases the unspooling and spooling of the hose end coupling 47.

Once the spool is empty, the operator retracts the drive wheel 63 from the now empty spool and moves the drive wheel sideways and then into contact with another spool. The hose is partially deployed so as to allow the hose couplings to be connected together. Then the trailer is moved forward so that the second length of hose can be deployed. In this manner, the hose from the trailer is laid on the ground.

Recovery of the hose follows the opposite procedure, where the length of hoses are wound on the individual spools.

By providing a number of spools on a single trailer, on a mobile platform, long lengths of hose can be laid (and recovered) more efficiently and with less labor. There is no need to change out spools or return to a central location for another full spool.

The trailer has provision for securing and deploying the hose couplings 47. The hose couplings on large diameter hoses can be heavy and difficult to lift up off of the ground. In addition, if the hose coupling is dropped on an operator, then injury could result.

The hose has two couplings. For purposes herein, the couplings will be discussed as an "inside" coupling and an "outside" coupling, to indicate their position on the spool when the hose is wound on the spool. The inside coupling is the interior coupling, while the outside coupling is on the outside end of the hose.

The inside coupling is located in the hub cavity 39. This allows a hose to be smoothly wound under the spool without the coupling interfering.

Figure 8:
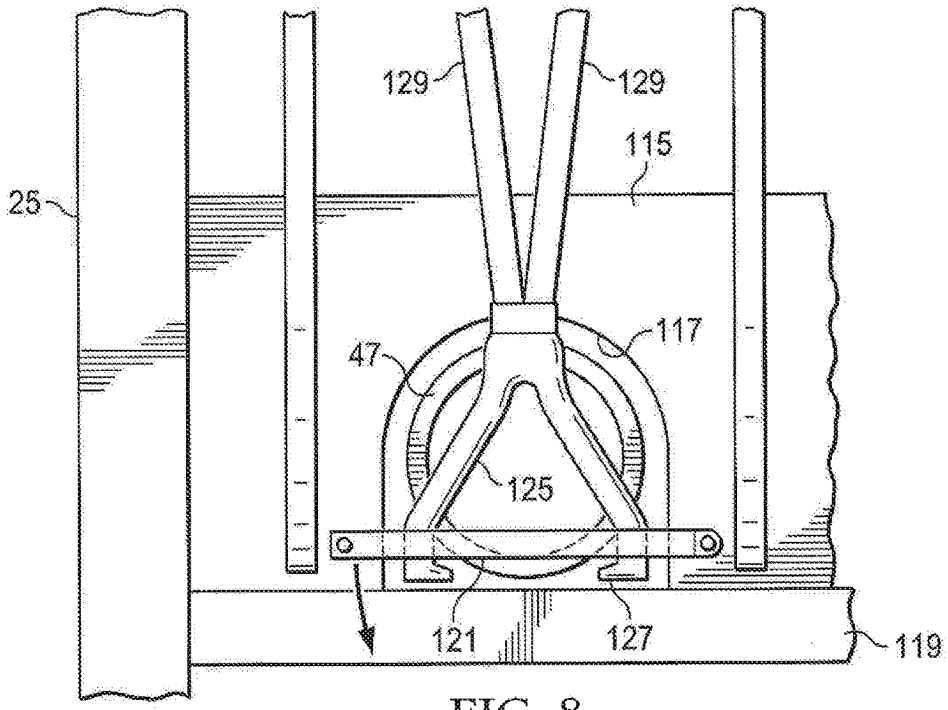
FIG. 8 is a plan view of a portion of the rear deck showing confinement of a hose coupling.

The outside coupling is secured to a horizontal deck plate 115 (see FIG. 8) when a full spool is not in use. The deck plate extends between the side supports 25 at the rear end of the trailer. The plate 115 has "U" shaped notches 117 cut into its rear edge 119. There is a notch 117 aligned with each spool 13. The notch is sized to receive a portion of the outside coupling 47 (shown in dashed lines in FIG. 8). A keeper bar 121 extends along the rear edge, closing off the notch. The keeper bar 121 can pivot about one end between open and closed positions. In the closed position, the keeper bar retains the coupling and the notch. In the open position, the coupling can be removed from the notch. The keeper bar is secured in the closed position by way of a pin or threaded screw.

A coupling puller 123 extends from the spool and is used to drop the inside coupling from the spool and pick the inside coupling up to go inside of the hub cavity. The coupling puller has a "V" shaped yoke 125, which yoke has a hook 127 on each end. A cable 129 extends from the yoke to the spool. In the preferred embodiment, the cable has two parts so as to form a "V" shape. The apex of the V cable is connected to the yoke and the legs of the V cable are connected to the cable spool, and specifically to the spokes, with one leg of the V cable connected, to each flange of the spool.

In operation, as the spool is unwinding the hose, when the only remaining part of the hose on the spool is the inside coupling 47, the yoke 125 is secured to the inside coupling in the hub cavity, if not already secured thereto. The spool is continued to be unwound, wherein the inside coupling exits the hub cavity. The coupling puller, with its cables 129, allows the inside coupling to pay out and be suspended. The coupling puller can be sufficiently long so that the inside coupling is laid on the ground.

To pick up the inside coupling from the ground, the yoke is connected to the coupling and then the spool is wound in the forward direction. The cable is wound around the spool hub and the cable yoke pick up the inside coupling. The length of the cable 129 is selected so that as the spool is wound, the yoke 125 and the inside coupling 47 are aligned with the hub opening 41 so that the inside coupling falls into the hub cavity.

As the spool continues to rotate to pick up the hose, the outside coupling will be lifted up off the ground by the hose itself. The outside coupling is placed into the respective notch 117 (see FIG. 8). The keeper bar 121 is pivoted in place and then secured in the closed position. This retains the outside coupling in place while the trailer is moving from place to place.

When the spool is empty of hose, the coupling puller is secured so as to not drag on the ground. Specifically, the yoke 125 is secured to the keeper bar 121 which is in the closed position. The spool is rotated so as to apply a solid knot of tension to the cable 129 in order to secure the yoke to the keeper bar.

Thus, the deck 115 serves to alternately secure either the outside coupling 47 or the coupling puller.

Spools that are not in use are secured or locked by conventional load binders 131 (see FIG. 2), which are anchored to the rear deck 115.

The foregoing disclosure and showings made in the drawings are merely illustrative of the principles of this invention and are not to be interpreted in a limiting sense.

The invention claimed is:

1. A large diameter lay-flat hose spool apparatus, comprising:

a) a mobile platform comprising a chassis and wheels;

b) side supports bearing on the chassis, the side supports extending up from the chassis and being separated from one another by a gap;

c) an axle supported by the side supports and spanning the gap;

d) plural spools rotatably mounted on the axle, each of the spools having at least one rim, each of the spools containing a length of the lay-flat hose, each length of the lay-flat hose having two ends and a coupling on each end;

e) a spool driver comprising a drive wheel, a first actuator and a second actuator, the first actuator moving the drive wheel into contact with and out of contact with a respective one of the spool rims, the second actuator moving the drive wheel from one of the spool rims to another of the spool rims;

f) a motor for rotating the drive wheel, wherein when the drive wheel contacts one of the spool rims and is rotated by the motor, the respective spool rotates independently of the other spools on the axle;

g) a controller system connected to the first actuator, the second actuator and the motor.

2. The large diameter lay-flat hose spool apparatus of claim 1, wherein the mobile platform comprises a trailer.

3. The large diameter lay-flat hose spool apparatus of claim 1, wherein each of the spools comprises a bushing that receives the axle.

4. The large diameter lay-flat hose spool apparatus of claim 1, wherein the at least one rim on each of the spools comprises an elastomeric surface that contacts the drive wheel when the respective spool is being driven by the drive wheel.

5. The large diameter lay-flat hose spool apparatus of claim 1, wherein the drive wheel, the motor and the first actuator are coupled to a sled, the sled moving on at least one rail, the rail extending between the side supports.

6. The large diameter lay-flat hose spool apparatus of claim 1, wherein the controller system comprises a first controller connected to the first actuator, a second controller connected to the second actuator and a third controller connected to the motor, the third controller capable of operating the motor in an unspool direction and a spool direction.

7. The large diameter lay-flat hose spool apparatus of claim 6, wherein the spools on the mobile platform have a forward end and a rearward end, the motor, the first actuator and the second actuator located on the forward end of the spools, the third controller located adjacent to the rearward end of the spools.

8. The large diameter lay-flat hose spool apparatus of claim 1, wherein the spools on the mobile platform have a forward end and a rearward end, further comprising:

a) a keeper notch for each spool, the keeper notches located adjacent to the rearward end of the spools, each keeper notch receiving one of the couplings from the respective spool;

b) for each of the keeper notches, a keeper bar located adjacent thereto, the respective keeper bars movable between a closed position and an open position, wherein when the respective keeper bar is in the closed position the respective keeper notch is closed and the respective coupling in the keeper notch is prevented from exiting the keeper notch, and when the respective keeper bar is in the open position the respective keeper notch is open and the respective coupling in the keeper notch can exit and enter the keeper notch.

9. The large diameter lay-flat hose spool apparatus of claim 8, further comprising a coupling puller on at least one of the spools, the coupling puller capable of being wrapped about the respective spool and capable of extending from the spool, the coupling puller having a free end with a grapple thereon, the grapple capable of attaching to one of the hose couplings.

10. The large diameter lay-flat hose spool apparatus of claim 1, wherein:

a) wherein the mobile platform comprises a trailer;

b) the at least one rim on each of the spools comprises an elastomeric surface that contacts the drive wheel when the respective spool is being driven by the drive wheel;

c) the drive wheel, the motor and the first actuator are coupled to a sled, the sled moving on at least one rail, the rail extending between the side supports;

d) the controller system comprises a first controller connected to the first actuator, a second controller connected to the second actuator and a third controller connected to the motor, the third controller capable of operating the motor in an unspool direction and a spool direction;

e) the spools on the mobile platform have a forward end and a rearward end, the motor, the first actuator and the second actuator located on the forward end of the spools, the third controller located adjacent to the rearward end of the spools.

11. A large diameter lay-flat hose spool apparatus, comprising:

a) a mobile platform comprising a chassis and wheels;

b) supports bearing on the chassis, the supports extending up from the chassis;

c) an axle supported by the supports;

d) a spool rotatably mounted on the axle, the spool having at least one rim, the spool containing a length of the lay-flat hose, each length of the lay-flat hose having two ends and a coupling on each end, the spools on the mobile platform have a forward end and a rearward end;

e) a spool driver mounted on the mobile platform, the spool driver rotating the spool so as to unroll the lay-flat hose from the spool and roll the lay-flat hose onto the spool;

f) a keeper notch located adjacent to the rearward end of the spool, the keeper notch receiving one of the couplings from the spool;

h) a keeper bar located on the keeper notch, the keeper bar movable between a closed position and an open position, wherein when the keeper bar is in the closed position the keeper notch is closed and the coupling in the keeper notch is prevented from exiting the keeper notch, and when the keeper bar is in the open position the keeper notch is open and the coupling in the keeper notch can exit and enter the keeper notch;

i) a coupling puller on the spool, the coupling puller capable of being wrapped about the spool and capable of extending from the spool, the coupling puller having a free end with a grapple thereon, the grapple capable of attaching to one of the hose couplings.

* * * * *